US006088841A

United States Patent [19]

Pozzer

[11] Patent Number: 6,088,841

[45] Date of Patent: Jul. 18, 2000

[54] PNEUMATIC PROTECTION DEVICE OF GREAT DIMENSIONS TO BE WORN BY THE USER WITH A VOCAL CONTROL

[76] Inventor: Carlo Pozzer, Via Tisati 7, Valli Del Pasubio, Vicenza, Italy

[21] Appl. No.: 09/288,259

[22] Filed: Apr. 8, 1999

Related U.S. Application Data

[63] Continuation-in-part of application No. 09/080,678, May 18, 1998, abandoned, which is a continuation-in-part of application No. 08/909,321, Aug. 14, 1997, abandoned.

[30] Foreign Application Priority Data

Nov. 6, 1996 [IT] Italy ..... VI96A0177

[51] Int. Cl.[7] ..... A41D 13/00

[52] U.S. Cl. ..... 2/456; 2/DIG. 3

[58] Field of Search ..... 2/456, 455, 463, 2/465, 467, 468, DIG. 3; 280/728.1, 730.1

[56] References Cited

U.S. PATENT DOCUMENTS

| | | | |
|---|---|---|---|
| 3,921,944 | 11/1975 | Morrison | 244/138 |
| 4,059,852 | 11/1977 | Crane | 2/2 |
| 4,089,065 | 5/1978 | McGee | 2/2 |
| 4,971,354 | 11/1990 | Kim | 280/733 |
| 4,977,623 | 12/1990 | DeMarco | 2/69 |
| 4,984,821 | 1/1991 | Kim et al. | 280/728 |
| 5,133,084 | 7/1992 | Martin | 2/2 |
| 5,362,098 | 11/1994 | Guill | 280/733 |
| 5,402,535 | 4/1995 | Green | 2/2 |
| 5,472,230 | 12/1995 | Every, Sr. et al. | 280/728.2 |
| 5,500,952 | 3/1996 | Keyes | 2/2 |
| 5,535,446 | 7/1996 | Pusic | 2/2 |
| 5,746,442 | 5/1998 | Hoyaukin | 280/730.1 |
| 5,781,936 | 7/1998 | Alaloof | 2/456 |

*Primary Examiner*—Michael A. Neas
*Attorney, Agent, or Firm*—Bucknam and Archer

[57] ABSTRACT

A system of inflatable pillows of great dimensions suitable to protect the totality or at least a part of the human body in the case of impacts, falls, etc. is characterized by the fact that it may be controlled by the voice of the individual to be protected by means of a microphone. The signal from the microphone is suitably elaborated by an electronic gear box and initiates the deflagration of a great quantity of a propellant which is in the form of cloth placed in the interior of the inflatable pillows.

8 Claims, 5 Drawing Sheets

PNEUMATIC PROTECTION DEVICE OF GREAT DIMENSIONS TO BE WORN BY THE USER WITH A VOCAL CONTROL

This application is a Continuation-in-part of U.S. Ser. No. 09/080,678, filed May 18, 1998, now abandoned, which was a Continuation-in-part of U.S. Ser. No. 08/909,321, filed Aug. 14, 1997, now abandoned.

FIELD OF THE INVENTION

This invention relates to a device to be used on garments for work, sports, for the purpose of protecting the individual and limiting the injuries which would result from a violent impact to which an individual during work or being engaged in sports activities could be subjected.

BACKGROUND OF THE PRIOR ART

The necessity of protecting the human body when an individual is subjected to violent decelerations is always more noticed by people who practice dangerous sports activities and in general by people who during work are exposed to blows or violent impacts.

In order to remedy these problems, industry has developed several safety systems particularly effective if the individuals to be protected are in the interior of a closed vehicle. Also, for the purpose of protecting people in an open vehicle or in general from falls, many possible systems have been developed. The protection by means of inflatable pillows commonly known as air bags is well known. It involves the use of garments being worn by the individuals to be protected on which are fixed one or more pillows ready to be inflated at the right moment or only shaped pillows in a manner to be fixed to the body. These inflatable pillows are of two types. According to the first type, after the inflation the tightness is almost hermetic and they in general are used to protect limited parts of the body and are effective only for the purpose of distributing a limited force of the blow on an ample surface of the body according to the dimensions of the pillow. According to the second type, on the contrary, the container of the pillow is provided with a plurality of openings of suitable dimensions in a manner that after the pillow has been inflated and subjected to a blow a substantial part of the energy is dissipated in the exiting action of the gas from the same openings. Also for the systems commonly used for the inflation of the gases, two systems are available, the first type providing the use of containers which contain compressed gas under high pressure, a system suitable for pillows of reduced capacity and hermetic tightness (see J. Crane, U.S. Pat. No. 4,059,852). The second type, on the contrary, utilizes a pyrotechnic propellant, a system greatly used in the air bags of automobiles, this system being particularly used for pillows of great capacity and dimensions with a case having openings for the purpose of dissipating the energy of the blow (see G. Guill, U.S. Pat. No. 5,362,098).

The period of time necessary for the inflation should also be considered. If the impulse of inflation is given subsequently to an impact, it should be noted that the useful period of time for inflation is extremely reduced so that one obtains a pillow of very modest dimensions and in any event absolutely inadequate to protect the body from blows at high speed.

It should also be noted that several air bags to be worn by the individuals are regularly already being sold. Starting from the presumption that only by wearing pneumatic pillows of great dimensions provided with openings for the exiting for the gas, it is possible to protect an individual from a very violent deceleration in the totality or at least a great part of the human body. The invention described hereinbelow provides a solution to the problem of obtaining pillows which are inflated in the manner and in the necessary period of time.

SUMMARY OF THE INVENTION

The object of the invention is to provide a protection against blows which operates according to the same principle of the air pillows or air bags and offers the following characteristics:

1. It is activated by the voice of the individual to be protected;
2. It is applied directly on the garment of the individual to be protected;
3. After it is inflated, it acquires a great volume;
4. Utilizes for the inflation a propellant cloth;
5. It may be constituted by several superimposed pillows.

Constructively, the protection device against blows of the present invention to be used on different garments which will be referred to hereinbelow with the generic term of overalls, is substantially composed of three parts.

1. An electric control circuit which sends to all the pillows the impulse of inflation;
2. A gas generator for the inflation of each pillow;
3. A plurality of inflatable containers or air pillows applied on the external surface of the overalls.

More specifically the containers or the air pillows are constituted essentially by bags made of a material equal or better than the material used to make the entire overalls. In fact, this material must offer substantial mechanical resistance, safe thermic resistance and substantial resistance to abrasion. By way of example, cloths constituted by a piece of nylon strengthened with particular fibers of the type of the product commercially available as polyamidic organic fibers having an aromatic chain may be mentioned.

In addition the filling of this material must be made in such a manner as to allow transpiration so as to allow the evacuation towards the exterior of the gas being used for the inflation of the pillows during the blow action for the purpose of making the impact less violent. The action of deflation of the pillow is finally regulated by the presence of openings made in the container. The number and the dimensions of the openings are related to the type of the blow which one must oppose. For instance, if one foresees a use of the pillows by an individual exposed to blows at high speed, the openings will be in a lower number or of smaller diameter.

The several air pillows formed on the overalls, after they are inflated, offer advantageous dimensions and volumes which are different in relation to the intensity of the foreseeable blow which they must oppose.

In condition of extreme danger there is provided the combination of several pillows in a manner to form after the inflation at least two superimposed layers of compartments separated one from the other. With this double arrangement, in addition to guaranteeing a less violent impact, there is always total safety in the case in which the more external pillow, due to sliding against the obstacle, may be broken and therefore be substantially deflated. The pillows are fixed on the worn garment by means of strong seams which are very resistant mechanically. It should also be noted that except for the superimposed disposition every other detail with respect to the air pillows or the containers are very well known in the present state of the art. The pillows must be fixed among themselves and on the garment being worn by means of strong, mechanically very resistant seams. Except for the superimposed arrangement of the pillows, every other detail with respect to the air pillows or the containers is well known in the art.

With respect to the gas generator, if one uses the pyrotechnic system to inflate a pillow of great dimensions, the substantial concentration of the explosive becomes dangerous. If one uses gas compressed in aerosol bombs for the purpose of inflating a very large pillow, the container becomes too big and in addition, the period of time for the inflation becomes excessively long. The explosive in the form of a cloth is not a novelty, but has been well known in the art and has been used mainly for military purposes. The use in the present case is essential because only in this form one may place in a rational and extensive manner the substantial quantity of explosive necessary to inflate a large pillow. This cloth will be fixed or sewn in the internal space of the pillow itself. The basic component of the explosive cloth may be sodium azide of the type which provides a progressive explosion so that also the inflation action of the same pillow becomes gradual, in the range of a few tenths of a second. It should also be noted that almost all the air bags which are mounted in auto vehicles use as the explosive sodium azide in granular form because its combustion generates nitrogen gas which is an inert gas and is not dangerous if it is inhaled. For the purpose of initiating the combustion of the explosive cloth, there is provided a triggering device commonly known also as the detonator which is fixed or sewn on the same cloth. The control of the triggering devices is electrical as the samples used in the air bags mounted in auto vehicles. As shown in the electrical scheme, two electrical cables come out from each detonator, the cables being connected to the electronic gear box.

In order to initiate the deflagration there is used an electronic gear box connected with all the pillows and activated by the voice of the individual who wears the overalls. In this manner the protection of the individual does not follow the occurrence of the accident, but may be foreseen by the individual who finds himself in a condition of danger. In particular, the gear box is provided in its interior with an electrical circuit which will be referred to hereinbelow with the general term of a vocal circuit which has the function of receiving the signal coming from the microphone and on the basis of a suitable programming recognizes only the particular type of sound having a specific intensity and based on the voice characteristics of the individual who wears the overalls against impact. If the sound which reaches the vocal circuit is that sound required for the activation of the overalls of the present invention, the electrical circuit is closed and the detonators receive the electrical impulse of the triggering device. At the present state of the art the electronic circuits used for recognizing a human voice are known such as for instance, the electronic vocal circuits of very limited dimensions mounted on portable cell telephones which are regularly sold such as Philips Genie™, Sam Sung SGH 600™, or the circuits being used for the vocal recognition used in the common personal computers used to write texts with the voice or initiating specific functions.

By way of example, the device of the present invention is particularly advantageously used in motorcycle races where the motorcyclist by emitting a determined sound signal causes as the final result the inflation of the protection pillows applied on the overalls prior to the impact with the ground or with other obstacles. The sound signal may be constituted by a word or by a particular shout emitted by the individual which is picked up by a microphone placed in the mouth or in proximity of the mouth applied for the purpose of protection or adhering externally to the vocal cords by means of a band-aid or supported by a necklace. The microphone being used is of the type shielded in such a manner as to pick up only the sound waves emitted by the well determined source. In addition, in the case in which the microphone is used in the interior of the mouth, it must be impermeable to water and as a fastening system to the interior of the mouth it is possible to use tweezers with a spring to be anchored to the teeth or a simple piece of chewing gum.

This manner of using the microphone results to be determinant because it is the only device which may be activated during a dynamic solicitation of the body.

The electronic gear box of very limited dimensions may be applied on the overalls being used for the protection of the individual or may be anchored externally, for instance on the frame of the motor. In view of the great dimensions of the pillows even when they are deflated, there is provided that the upper part of the overalls is provided with a quick unhooking device with electromagnetic unblocking which after it is opened, it allows the quick unwinding of the garment. The unhooking occurs by means of an electric signal emitted by the gear box automatically after a certain period of time from the impact or by means of direct action of a push button located in the same gear box. The gear box is completed with an interruption device for the activation/deactivation with a light signal which indicates the conditions "on/off".

These and other characteristics of the invention will be more clear by reference to the description of a possible embodiment described herein by way of a nonlimiting example by reference to the accompanying drawings of which:

Figure 1:
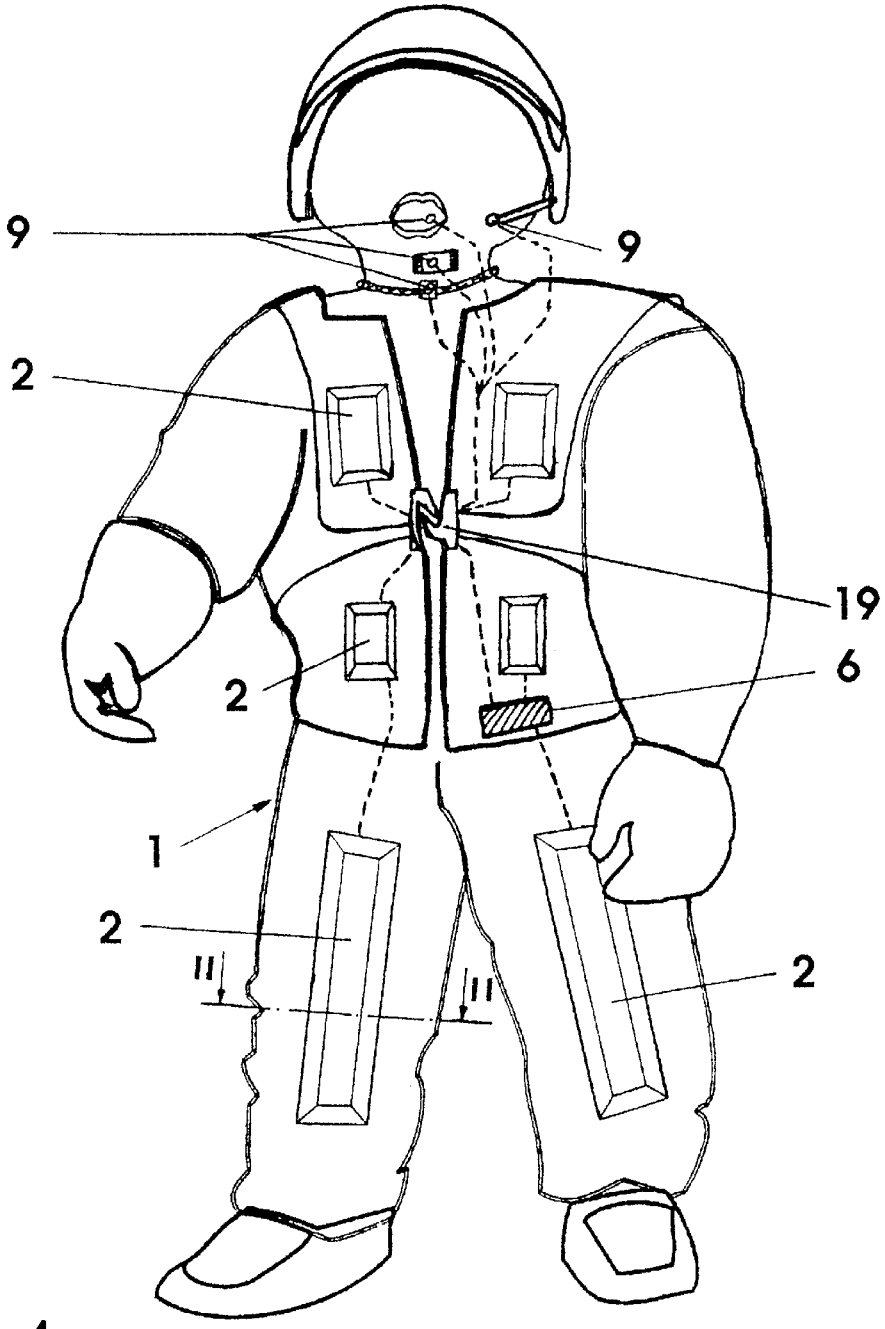
FIG. 1 shows an overall provided with the protection device according to the present invention.

As shown in FIG. 1, numeral 2 designates anti-impact protections located on the external surface of the garment 1 which could be for instance, an overall for a motorcyclist. These protections 2 are placed corresponding to the areas of the body which need most protection.

Figure 2:
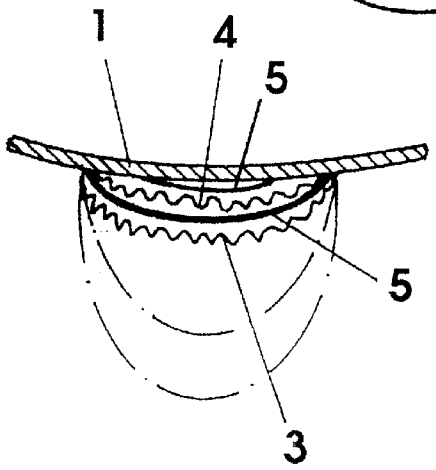
FIG. 2 illustrates a cross section according to line II—II in FIG. 1 of the inflatable pillow which utilizes for the inflation the propellant cloth.

As shown in FIG. 2, every anti-impact protection 2 is constituted by two bags 3 and 4 which function as inflatable pillows.

In the space between the two bags 3 and 4 there is placed a portion of propellant cloth 5 which generates the inflation gas.

The function of the anti-impact protection is regulated by means of electronic gear box 6 which is placed advantageously corresponding to the belt of the overall and which receives the signals of impact and provides to transmit the impulses for the inflation to the several pillows.

Figure 3:
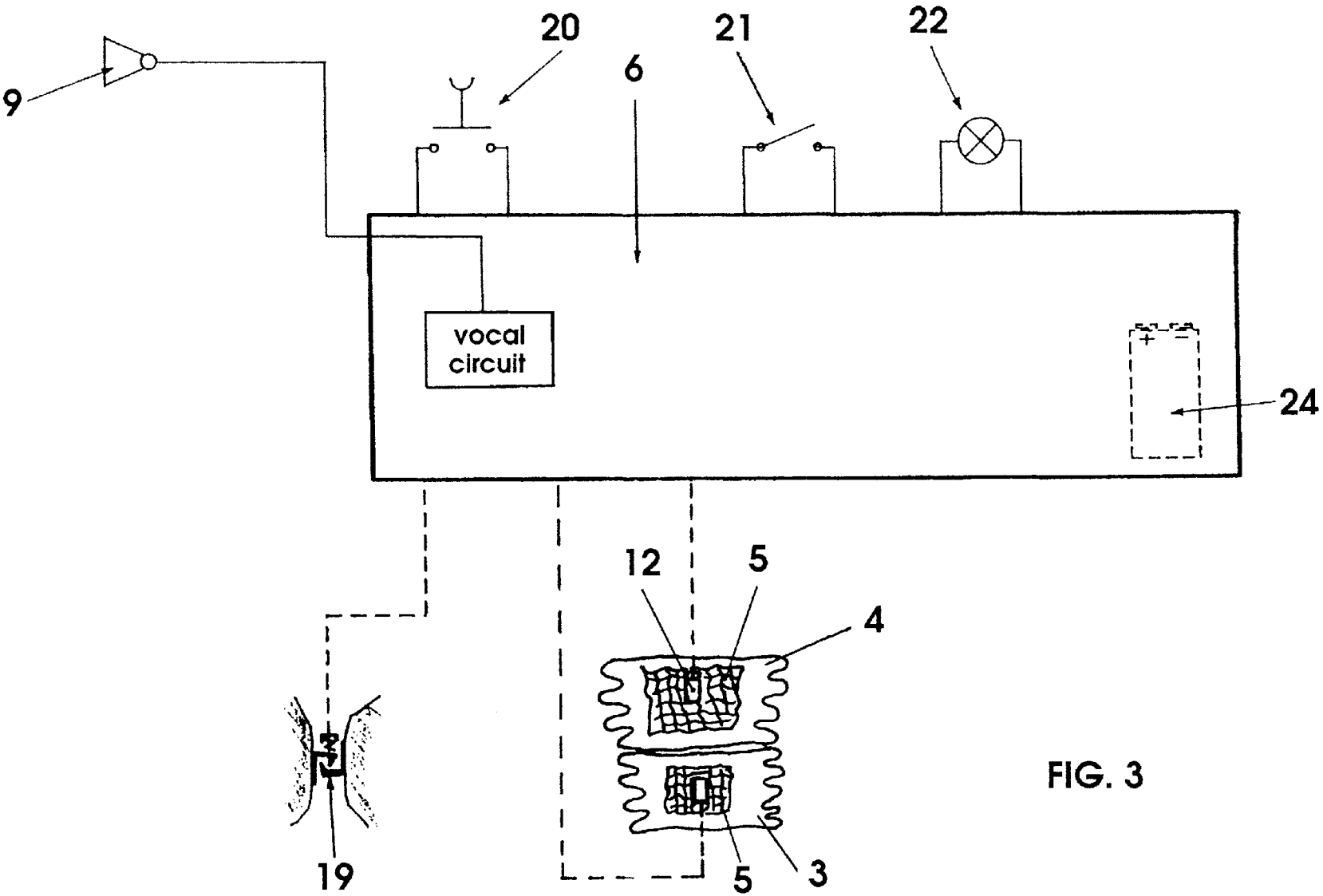
FIG. 3 shows the functioning scheme of the installation of the control gear box.
Figure 4:
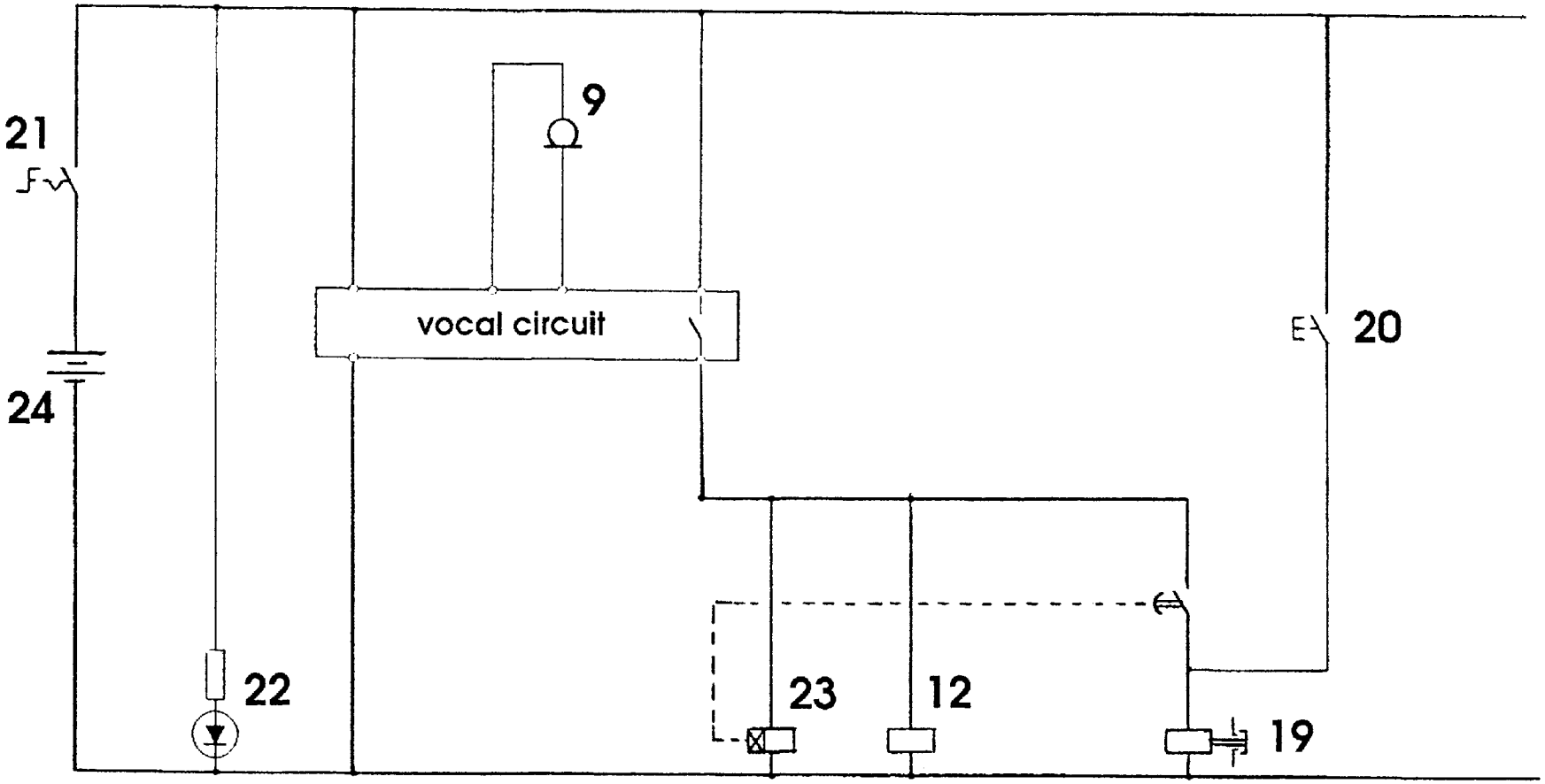
FIG. 4 illustrates the electrical scheme according to the invention.
Figure 6:
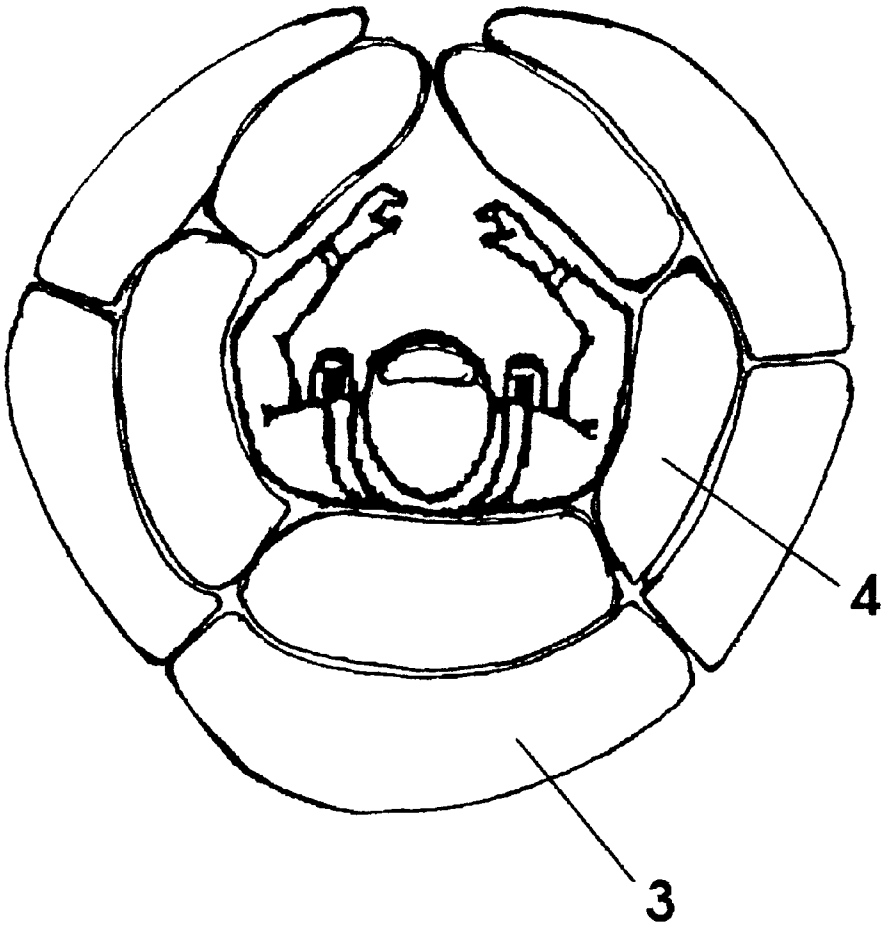
FIG. 6 shows an overall after the inflation.
Figure 5:
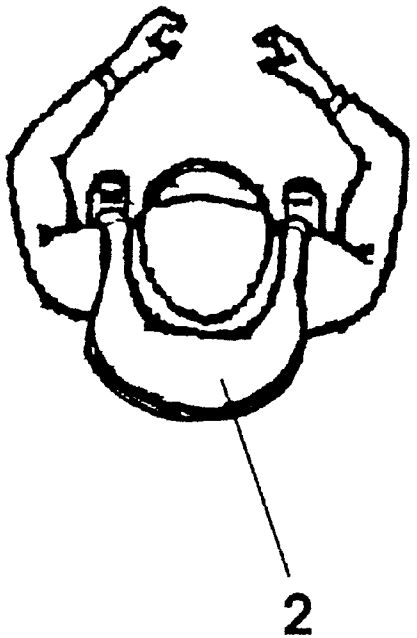
FIG. 5 shows an overall in the inactive condition.
Figure 7:
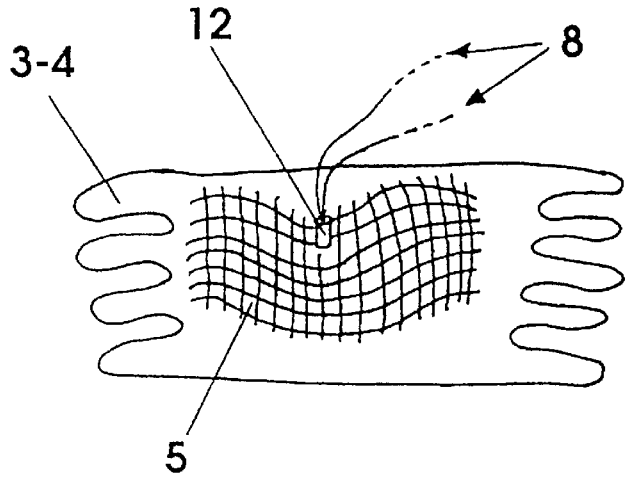
FIG. 7 shows the explosive cloth placed in the interior of a bag.
Figure 8:
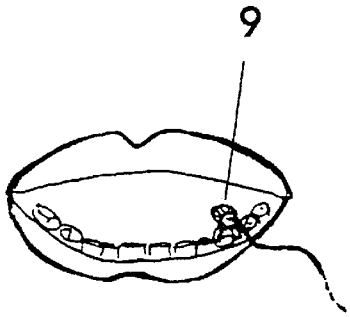
FIG. 8 shows the microphone being located in the mouth of the wearer.
Figure 9:
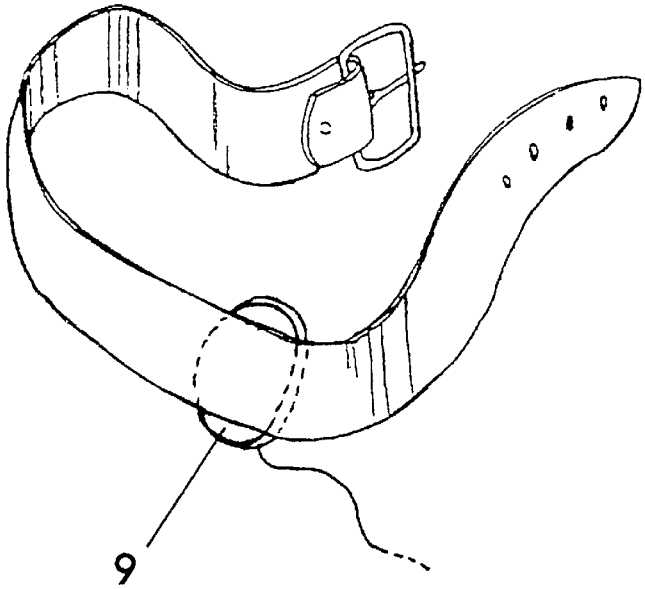
FIG. 9 shows the microphone supported by a necklace.
Figure 10:
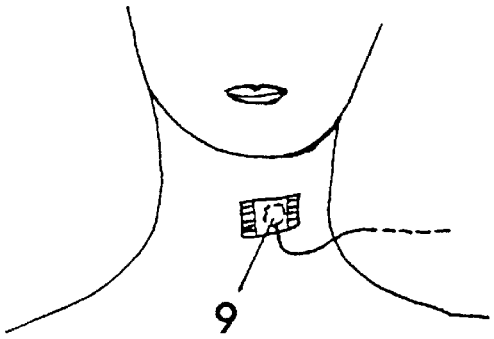
FIG. 10 shows the microphone anchored to the neck of the wearer by means of a bandaid.

As shown in FIG. 3 and the electronic circuit of FIG. 4, the impact signals may be communicated to the gear box by microphone 9. The exiting signals emitted by the gear box stimulate the several inflation devices designated by the bags 3 and 4 which contain the propellant cloth 5, the latter being placed in deflagration by means of the corresponding detonator 12 which is connected to the gear box 6 by means of cable 8.

The gear box in addition provides to transmit a signal for the unhooking of closure hook 19 which is located in the jacket of the overalls. This operation may occur automatically after a period of time which is programmed by means of a temporizing device 23 or manually by means of a push button 20 which is located in the same gear box.

The gear box 6 is also provided with a manual interruption device "on/off" 21 which provides for the activation/deactivation and with a light device 22 and is used in an independent manner by means of source of energy 24.

What is claimed is:

1. An anti-impact protection device composed by inflatable pillows, said pillows being capable of protecting a substantial portion of the body of the wearer in the case of impact, fall or violent deceleration, said device being controlled by the voice of the wearer to be protected by means of a microphone, an electronic gear box which emits the signal emitted by said microphone, said signal initiating the deflagration of substantial amount of propellant, said propellant being a cloth placed in the interior of said inflatable pillows.

2. The protection device according to claim 1 characterized by the fact that the activation of said gear box for the purpose of activating the inflation of the plurality of pillows occurs by emission of a sound signal picked up by said microphone.

3. The protection device according to claim 2 characterized by the fact that the sound signal for the activation of said gear box is emitted by the individual who wears the protection garment.

4. The protection device according to claim 2 characterized by the fact that the vocal sound signal is picked up by a microphone located in the proximity of the mouth of the wearer to be protected.

5. The protection device according to claim 2 characterized by the fact that the microphone is located in the interior of the mouth of the wearer to be protected.

6. The protection device according to claim 2 characterized by the fact that the microphone is located externally near the vocal cords of the wearer to be protected by means of adhesive support or a mechanical device, said microphone being shielded in such a manner as to pick up only the sound waves emitted by the same vocal cords.

7. The protection device according to claim 1 characterized by the fact that the inflation gas of each bag is obtained by deflagration of propellant cloth inserted in the space of the pillow to be inflated, said propellant being constituted by a base of sodium azide.

8. The protection device according to claim 1 characterized by the fact that each portion of said protection device is constituted by at least two bags, one bag being superimposed on the other whereby after they are inflated two layers of compartments are obtained, said compartments being separated one from the other.

* * * * *